US006359376B1

(12) United States Patent
Hollstein et al.

(10) Patent No.: US 6,359,376 B1
(45) Date of Patent: Mar. 19, 2002

(54) FLUORESCENT LAMP HAVING ASYMMETRIC ELECTRODES INSIDE THE DISCHARGE TUBE

(75) Inventors: Andreas Hollstein, Ingolstadt; Martin Beck, Augsburg, both of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/383,979

(22) Filed: Aug. 26, 1999

(30) Foreign Application Priority Data

Sep. 18, 1998 (DE) ..... 198 42 795

(51) Int. Cl.[7] ..... H01J 1/02; H01J 61/52; H01J 7/24

(52) U.S. Cl. ..... 313/46; 313/491; 313/485

(58) Field of Search ..... 313/39, 40, 44, 313/45, 46, 491, 493, 620, 621, 631, 485, 594, 642

(56) References Cited

U.S. PATENT DOCUMENTS 1,915,019 A * 6/1933 Ewest et al. ..... 313/642
2,491,854 A * 12/1949 Force ..... 313/594
5,081,395 A * 1/1992 Kikuchi et al. ..... 313/594
5,680,000 A * 10/1997 Zuk et al. ..... 313/25
5,808,418 A * 9/1998 Pitman et al. ..... 315/115
5,952,768 A * 9/1999 Strok et al. ..... 313/110

FOREIGN PATENT DOCUMENTS

EP 0913628 A2 * 5/1999 ..... F21V/29/00
JP 9-17383 * 1/1997 ..... H01J/61/34

* cited by examiner

*Primary Examiner*—Nimeshkumar D. Patel
*Assistant Examiner*—Karabi Guharay
(74) *Attorney, Agent, or Firm*—Carlo S. Bessone

(57) ABSTRACT

A fluorescent lamp 1 for exterior lighting having a discharge tube 2 of less than or equal to 26 mm outside diameter. Starting from a fluorescent lamp for interior use having a discharge tube 2 of less than or equal to 26 mm, it is possible to achieve optimum operation of the fluorescent lamp 1 in the case of exterior use by applying a thermally conducting material in the form of a coating of foil 15, 16 outside on the discharge tube 2 in the region of one or both electrodes 3, 4.

8 Claims, 1 Drawing Sheet

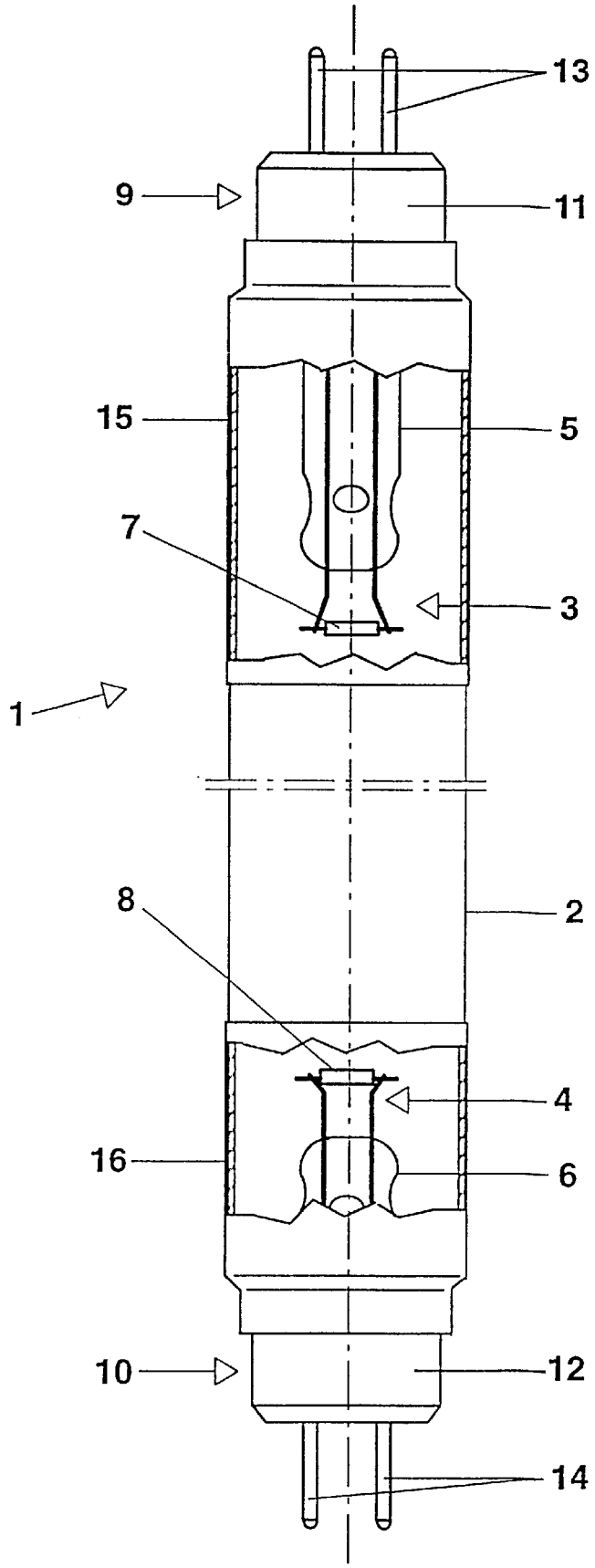
13
9
11
15
5
7
3
1
2
8
4
16
6
10
12
14

FLUORESCENT LAMP HAVING ASYMMETRIC ELECTRODES INSIDE THE DISCHARGE TUBE

TECHNICAL FIELD

The invention proceeds from a fluorescent lamp in accordance with the preamble of claim 1.

PRIOR ART

In the case of the known fluorescent lamps with outside tube diameters of greater than 26 mm, such as the T12 lamps with 38 mm, for example, the temperature of the cold spot at which the excess mercury condenses and which ensures an optimum luminous flux during operation of the lamp, is designed for an ambient temperature of approximately 25° C. The cold spot is situated in this case in the middle of the discharge tube on the inner glass wall.

In the case of the new fluorescent lamps with outside tube diameters of less than or equal to 26 mm (T8, T5), which have been developed specifically for interior lighting (ambient temperature of greater than 25° C.), the temperature of the cold spot must be approximately 40° C. so that an optimum light yield is achieved. This is reached at an ambient temperature of approximately 35° C. With decreasing inside diameter, it is necessary to displace the cold spot from the middle of the lamp to a point behind the electrodes, since because of the ever increasing current density it is no longer possible to reach such a low temperature of approximately 40° C. in the middle of the discharge tube. For this purpose, one electrode is displaced further into the discharge tube by the formation of a longer stem seal, so that a cold spot of approximately 40° C. can form behind this electrode.

Since these lamps have been very well received because of their high light yield and their slim finish, it was of interest also to make use of these lamps in exterior lighting (ambient temperatures of less than 25° C.). However, the temperature of the cold spot behind the electrode is not designed for this purpose, with the result that it is not possible to achieve optimum light yields with these lamps.

SUMMARY OF THE INVENTION

It is the object of the present invention to provide a fluorescent lamp having a discharge tube with an outside diameter of less than or equal to 26 mm in accordance with the preamble of claim 1, which ensures an optimum light yield even in the case of exterior operation with relatively cold ambient temperatures of less than 25° C. It should be possible to achieve the object using simple means, and there should be no fundamental changes to the lamp design as a result.

This object is achieved by means of the characterizing features of claim 1. Particularly advantageous refinements are to be found in the dependent claims.

By providing a material which is a good conductor of heat in the region of the electrode displaced further into the discharge tube, the heat in the glass tube in the region of this electrode can be directed toward the base. As a result, the cold spot is displaced from a point behind the electrode into the middle of the lamp again, where it then acquires an optimum temperature because of the lower outside temperatures of less than 25° C.

The thermally conducting material preferably consists of a thermally conducting coating on the outer wall of the discharge tube, or of a thermally conducting foil which surrounds the discharge tube in this region over the entire outer circumference. Such a thermally conducting material is also preferably applied or provided outside on the glass tube in the region of the other sealed electrode.

For optimum heating, the thermally conducting material should reach at least from the electrode filament to the edge of the base shell. It is even better if the thermally conducting material reaches beyond the electrode filament in the direction of the middle of the glass tube and—in the case of a foil—is soldered or welded to the case shell. In the case of a thermally conducting foil, the latter preferably contains aluminum or copper.

DESCRIPTION OF THE DRAWINGS

The invention is explained in more detail below with the aid of an exemplary embodiment.

A straight fluorescent lamp 1 in accordance with the invention is reproduced in the figure in a partially sectioned and shortened form. The fluorescent lamp 1 with a power consumption of 54 W has a discharge tube 2 made from glass with an outside diameter of 16 mm and a length of 1 150 mm, and in each of its ends an electrode 3, 4 is respectively sealed on a stem 5, 6. The stem 5 of one electrode 3 is 20 mm longer in this case, with the result that the filament 7 of one electrode 3 is 20 mm further from the associated end of the discharge tube 2 than the filament 8 of the other electrode 4. The bases 9, 10 with base shells 11, 12 and base pins 13, 14 which are electrically connected to the electrodes 3, 4 are applied to the two ends of the discharge tube 2. The fluorescent lamp l also has a fluorescent coating on the inside of the discharge tube 2 which is not represented—because of clarity.

In this respect, this fluorescent lamp 1 according to the invention corresponds to a fluorescent lamp for interior use, a cold spot with a temperature of 40° C. being formed at an ambient temperature of approximately 35° C. during interior operation behind the electrode filament 7 on the longer stem 5, and thereby ensuring optimum emission of luminous flux.

According to the invention, the two ends of a discharge tube 2 are tightly surrounded by a sleeve made from a copper-aluminum foil 15, 16 of thickness approximately 0.1 mm, which starts 5 mm (seen from the middle of the discharge tube 2 in the direction of the end) before the respective electrode filament 7, 8, and overlaps the base shell 11, 12 by about 5 mm.

These additional foil sleeves 15, 16 create a fluorescent lamp for exterior use from a fluorescent lamp for interior use. During operation, the foil sleeves 15, 16 ensure strong heating of the interior behind the electrode filaments 7, 8, with the result that the cold spot now forms in the middle of the discharge tube 2 on the inner wall. In the case of exterior use with an ambient temperature of approximately 5° C., during operation the cold spot assumes a temperature of approximately 40° C., with the result that an optimum emission of luminous flux is set up at this outside temperature.

What is claimed is:

1. A fluorescent lamp (1) for exterior lighting comprising a straight or circularly bent discharge tube (2) made from glass with a circular cross section of less than or equal to 26 mm outside diameter, an electrode (3, 4) sealed into each end of the discharge tube (2), one electrode (3) being arranged at a somewhat greater distance from the end of the discharge tube (2) than the other electrode (4) so that a cold spot can form behind this electrode, a fluorescent coating on the inner wall of the discharge tube (2) and a mercury-inert gas filling as well as a base (9, 10) fitted respectively at either end of the discharge tube (2) and having at least one base pin (13, 14) and a base shell (11, 12) wherein at least in the region of one electrode (3) sealed at a somewhat greater distance from the end of a discharge tube (2) a material which is a good conductor of heat is provided outside on the discharge tube (2).

2. The fluorescent lamp as claimed in claim 1, wherein in the region of the other sealed electrode (4) as well, a material which is a good conductor of heat is provided outside on the discharge tube (2).

3. The fluorescent lamp as claimed in claim 1, wherein the thermally conducting material consists of a thermally conducting coating.

4. The fluorescent lamp as claimed in claim 3, wherein the thermally conducting foil is soldered or welded to the base shell.

5. The fluorescent lamp as claimed in claim 1, wherein the thermally conducting material consists of a thermally conducting foil (15, 16).

6. The fluorescent lamp as claimed in claim 1, wherein the thermally conducting material reaches at least from the filament (7, 8) of the electrode (3, 4) up to the inner edge of the base shell (11, 12).

7. The fluorescent lamp as claimed in claim 6, wherein the thermally conducting material surrounds the discharge tube (2) over the entire outer circumference.

8. The fluorescent lamp as claimed in claim 1, wherein the thermally conducting foil (15, 16) contains aluminum and/or copper.

* * * * *